US006401820B1

(12) United States Patent
Kirk et al.

(10) Patent No.: US 6,401,820 B1
(45) Date of Patent: Jun. 11, 2002

(54) DOWNHOLE TOOL

(75) Inventors: Ian Alastair Kirk; William Barron; Alistair Bertrum Clark, all of Aberdeen (GB)

(73) Assignee: Downhole Products PLC (GB)

( * ) Notice: Subject to any disclaimer, the term of this patent is extended or adjusted under 35 U.S.C. 154(b) by 0 days.

(21) Appl. No.: 09/446,930

(22) PCT Filed: Jan. 24, 1998

(86) PCT No.: PCT/GB99/00093

§ 371 (c)(1),
(2), (4) Date: Dec. 29, 1999

(87) PCT Pub. No.: WO99/37881

PCT Pub. Date: Jul. 29, 1999

(30) Foreign Application Priority Data

Jan. 24, 1998 (GB) ..... 9801494
Jun. 2, 1998 (GB) ..... 9811852

(51) Int. Cl.[7] ..... E21B 17/14

(52) U.S. Cl. ..... 166/311; 166/242.8; 175/323; 175/402

(58) Field of Search ..... 166/242.8, 311; 175/323, 385, 391, 402

(56) References Cited

U.S. PATENT DOCUMENTS 1,786,761 A * 12/1930 Little ..... 166/242.8
5,697,442 A * 12/1997 Baldridge ..... 166/242.8
5,740,862 A * 4/1998 Sable ..... 166/241.4
6,062,326 A * 5/2000 Strong et al. ..... 175/402

FOREIGN PATENT DOCUMENTS

WO 93/18274 * 9/1993 ..... 175/402

* cited by examiner

*Primary Examiner*—William Neuder
(74) *Attorney, Agent, or Firm*—Gifford, Krass, Groh, Sprinkle, Anderson & Citkowski, P.C.

(57) ABSTRACT

A tubing shoe (30) comprising: a body (32) for mounting on the end of a tubing string; and reaming members (36) extending longitudinally and helically around the body, the reaming members providing substantially complete circumferential coverage of the body whereby, in use, when the tubing shoe is advanced axially into a bore, the reaming members (36) provide reaming around the shoe circumference. A rotatable torque reducing sleeve or centraliser (38) may also be mounted on the body, rearwardly of the reaming members.

46 Claims, 2 Drawing Sheets

DOWNHOLE TOOL

This invention relates to a downhole tool, and in particular to a casing or liner shoe.

In oil and gas exploration and production operations, bores are drilled to gain access to subsurface hydrocarbon-bearing formations. The bores are typically lined with steel tubing, known as tubing, casing and liner, depending upon diameter, location and function. Bores may also be lined with a filtration medium, such as slotted pipe or tube, or filtration media comprising a combination of two or more of slotted pipe or tubing, slotted screens or membranes and sand-filled screens. Embodiments of the present invention may be useful in some or all of these applications, and for brevity reference will generally made to "tubing". The tubing is run into the drilled bore from the surface and suspended or secured in the bore by appropriate means, such as a casing or liner hanger. For casing, cement may then be introduced into the annulus between the tubing and the bore wall.

As the tubing is run into the bore the tubing end will encounter irregularities and restrictions in the bore wall, for example ledges formed Where the bore passes between different formations and areas where the bore diameter decreases due to swelling of the surrounding formation. Further, debris may collect in the bore, particularly in highly deviated or horizontal bores. Accordingly, the tubing end may be subject to wear and damage as the tubing is lowered into the bore.

These difficulties may be alleviated by providing a "shoe" on the tubing end. Proposals for casing shoes of various forms are described in Canadian Patent No. 1,222,446, U.S. Pat. Nos. 2,334,788 and 4,825,947 and International Patent Application WO96/28635.

It is among the objectives of embodiments of the present invention to provide an improved tubing shoe.

According to the present invention there is provided a tubing shoe comprising a body for mounting on the lower end of rotatable tubing, and a rigid reaming portion comprising reaming members extending helically around the body towards the leading end thereof in an opposite direction to the intended direction of rotation of the tubing.

According to another aspect of the present invention there is provided a method of reaming a bore in preparation for receiving tubing, the method comprising the steps of:

mounting a tubing shoe on the lower end of tubing, the tubing shoe comprising a body and reaming members extending helically around the body towards the leading end thereof in one direction; and running the tubing into a bore while rotating the tubing in the opposite direction to said one direction.

In use, these aspects of the present invention facilitate running in of tubing such as casing or liner which is supported or mounted such that it may be rotated as it is run into a bore: liner is typically run in on drill pipe, which may be rotated from surface as necessary; casing may be rotated using a top drive. In the interest of brevity, reference will be made herein primarily to liner. By providing reaming members which extend helically around the body in the opposite direction to the rotation of the liner, the rearing members do not tend to "bite" into obstructions in the bore wall; in conventional shoes provided with helical blades or flutes which extend in the same direction as the rotation of the liner the blades tend to engage obstructions, in a similar manner to a screw. In contrast, in the present invention, the members will tend to ride on or over any obstruction as the members ream the bore to the desired diameter to allow the liner to pass. This minimises the possibility of the shoe and liner becoming stuck fast in the bore due to the shoe becoming locked with a bore obstruction.

While the body and reaming portion are preferably substantially cylindrical, the leading end of each reaming member may define a pilot reaming portion defining a smaller diameter than a subsequent reaming portion. Most preferably, the reaming portions include a cutting or rasping surface or inserts on an outer surface of the portions, such as blocks or inserts of tungsten carbide, diamond or other hard material welded or otherwise fixed to the body or reaming members. The pilot and subsequent reaming portions of each reaming member may be helically aligned, or may be staggered. In a preferred embodiment, the reaming members are provided with inserts of hard material, such an tungsten carbide; testing hat shown that such inserts provide more effective cutting and members provided with such inserts are harder wearing. It is believed that the ability to press the inserts into interference fit holes or slots avoids the stresses and other material property changes induced by welding blocks of tungsten carbide in place, and the inserts are spaced apart on the reaming members and are effectively self-cleaning, unlike traditional welded tungsten carbide blocks which require cleaning and often become "clogged".

Each reaming member may include a stabilising portion, which may extend rearwardly of a reaming portion. Most preferably, the stabilising portion has a relatively smooth and hard wearing outer surface, for example of machined tungsten carbide. Alternatively, or in addition, a torque reducing sleeve or centraliser may be provided on the body rearwardly of the reaming portion. Preferably, the centraliser is spaced rearwardly of the reaming portion. Most preferably, the centraliser is rotatable relative to the body. In the preferred embodiment, the centraliser defines a bushing or sleeve, and one or more fluid conduits may carry fluid to provide lubrication between the bushing and the shoe body. In other embodiments the fluid conduits may be omitted. The centralizer may define raised helical flutes or blades. Preferably, the blades extend in the same direction as the intended direction of rotation of the shoe, that is in the opposite direction to the reaming members. In other embodiment the centraliser blades may extend in the same direction as the reaming members. The centraliser blades may include one or both of axial lead in and lead out portions, the portions facilitating relative axial movement of the centraliser relative to the bore wall. In ocher embodiments, the centraliser blades may be "straight", that is extend solely axially.

Alternatively, or in addition, further torque reducing sleeves or centralizers may be provided rearwardly of the shoe or or the liner itself.

The trailing edge of each reaming member may define a back reaming portion, which back reaming portions may include a cutting or rasping surface, such as blocks or inserts of tungsten carbide or other hard material welded, located in bores, or otherwise fixed to the body. This feature is useful in shoes having a reduced diameter portion in which material may gather or become trapped, hindering retraction or withdrawal of the shoe. In the preferred embodiment of the invention there is little or no reduction in shoe body diameter following the reaming members, such that it is not necessary to provide the back reaming feature. Most conveniently, the shoe tapers towards the leading and thereof.

The body may define a fluid transmitting conduit in communication with fluid outlets located between the reaming members; due to the orientation of the members, the rotation of the shoe will not tend to clear cuttings and other material from the channels or flutes between the members, and passing fluid into the channels facilitates maintaining the channels clear of cuttings and the like. Most preferably, the fluid outlets are arranged to direct fluid rearwardly of the leading end of the shoe. Conveniently, at least adjacent fluid outlets are longitudinally offset, to minimise weakening of the shoe body. In other embodiments, such fluid outlets may be provided on a nose portion on the body, the outlets being arranged to direct fluid rearwardly towards or between the reaming members.

Preferably also, the body includes a nose portion, preferably an eccentric nose portion, that is the leading end of the nose portion is offset from the shoe axis. Most preferably, the nose portion is of a relatively soft material, for example an aluminum or zinc alloy, or indeed any suitable material, to allow the nose to be drilled out once the liner has been located in a bore. The nose portion may define one or more jetting ports, depending upon the desired flow rate of fluid from the nose portion. One or more jetting ports may be provided toward a leading end of the nose portion; in one preferred embodiment, a jetting port may be provided aligned with the shoe axis. One or more jetting ports may be provided toward a trailing end of the nose portion: in one preferred embodiment a plurality of spaced jetting ports are provided around a base of the nose portion and, in use, direct fluid rearwardly towards the reaming members. The one or more ports provided on the nose portion may open into respective recesses in the nose portion surface, to facilitate in the prevention of the jetting ports becoming blocked or plugged. In the preferred embodiment, the nose portion is rotatable relative to the body, to facilitate passage of the shoe over ledges and the like. Most preferably, the nose is rotatable only to a limited extent, for example through 130°; this facilitates the drilling or milling out of the nose. Of course, if the nose portion is not required to be drillable, the nose portion may be freely to rotatable relative to the body. The nose may be biassed towards a particular "centred" orientation by a spring or the like.

According to a further aspect of the present invention there is provided a tubing shoe comprising: a fluid transmitting body for mounting on the lower end of tubing; reaming members on the body; and fluid outlets for directing fluid towards or between the members.

Preferably, the fluid outlets are arranged to direct fluid rearwardly of the leading end of the shoe.

Preferably also, at least adjacent fluid outlets are longitudinally offset.

The fluid outlets may be provided in a nose located on the leading end of the shoe.

According to a still further aspect of the present invention there is provided a method of reaming a bore in preparation for receiving tubing, the method comprising the steps of:

mounting a tubing shoe on the lower end of tubing, the tubing shoe comprising a fluid transmitting body, reaming members on the body, and fluid outlets for directing fluid towards or between the members;

running the tubing into a bore; and passing fluid through said outlets.

According to another aspect of the present invention there is provided a tubing shoe comprising a body for mounting on the lower end of tubing, and reaming members on the body, the leading end of each reaming member defining a pilot reaming portion defining a smaller diameter than a subsequent reaming portion.

Preferably, the reaming members each define a cutting or rasping surface, such as blocks or inserts of tungsten carbide or other hard material welded, held in bores or slots or otherwise fixed to the body. Most preferably, the remaining members extend helically around the outer surface of the body. Preferably also, the cutting or rasping surfaces of the reaming members combine to provide substantially complete coverage around the circumference of the body. Thus, even if there is no rotation of the shoe as it is advanced into a bore, there is cutting or rasping capability around the circumference of the bore and the bore is reamed to at least a minimum diameter corresponding to the diameter defined by the cutting or rasping surface.

According to another aspect of the present invention there is provided a tubing shoe comprising: a body for mounting on the end of a tubing string; and reaming members extending longitudinally and helically around the body, the reaming members providing substantially complete circumferential coverage of the body whereby, in use, when the tubing shoe is advanced Axially into a bore, the reaming members provide reaming around the shoe circumference.

According to a further aspect of the present invention there is provided a method of clearing a bore to receive tubing, the method comprising:

mounting a tubing shoe on the end of a tubing string, the shoe having reaming members extending longitudinally and helically around the body, the reaming members providing substantially complete circumferential coverage of the body; and advancing the tubing shoe axially into the bore, the reaming members provide reaming around the shoe circumference.

These aspects of the invention are of particular application in tubing shoes which are not subject to rotation during running in to a bore.

The inclination of the reaming members to the longitudinal axis of the the Many be constant or may vary over the length of the members, for example the members may include portions parallel of perpendicular to the shoe longitudinal axis.

According to a further aspect of the present invention there is provided a tubing shoe comprising: a body for mounting on the end of a tubing string; and a nose rotatably mounted on the body.

Preferably, the nose is rotatable about a longitudinal axis.

Preferably also, the degree of rotation of the nose relative to the body is restricted, to facilitate drilling or milling through the nose.

According to a still further aspect of the present invention there is provided a tubing shoe comprising; a body for mounting on the end of a tubing string; and a torque reducing sleeve or centraliser on the body.

Preferably, the centraliser is rotatably mounted on the body. Most preferably, the body defines a fluid conduit and a bearing area between the centraliser and the body is in fluid communication with the conduit, to supply lubricating fluid to the bearing area.

Preferably also, the centraliser defines external blades or flutes. The blades may extend helically, and may include one or both of substantially axial lead in and lead out portions. Where the shoe includes reaming members, the centralizer blades may extend in the same or the opposite direction to the reaming members.

According to a yet further aspect of the present invention there is provided a tubing shoe comprising:

a body for mounting on the end of a tubing string; and a rigid reaming portion comprising reaming members extending helically around the body and comprising inserts of relatively hard material on bearing surfaces of the reaming members.

The various aspects of the invention as described above may be manufactured and assembled by various methods. For example, the body and reaming members may be machined from a single billet. However, it is preferred that The body is formed of a single part on which a sleeve defining the reaming members is mounted. A centralising sleeve may also be provided for mounting on the body. Conveniently, the body defines a reduced diameter portion on which one or more sleeves are mounted. A rotating sleeve, such as a centraliser, may be retained by a locking ring or the like. A fixed sleeve, such as carries the reaming members, may be pinned to the body, and the pin may also serve to retain a nose portion on the body.

The various aspects of the invention as described above may be provided singly or in combination with one or more of the other aspects. Further, if desired the various aspects of the invention may be provided in combination with one or more of the optional or preferred features of the other aspects of the invention.

These and other aspects of the present invention will now be described, by way of example, with reference to the accompanying drawings, in which.

Figure 1:
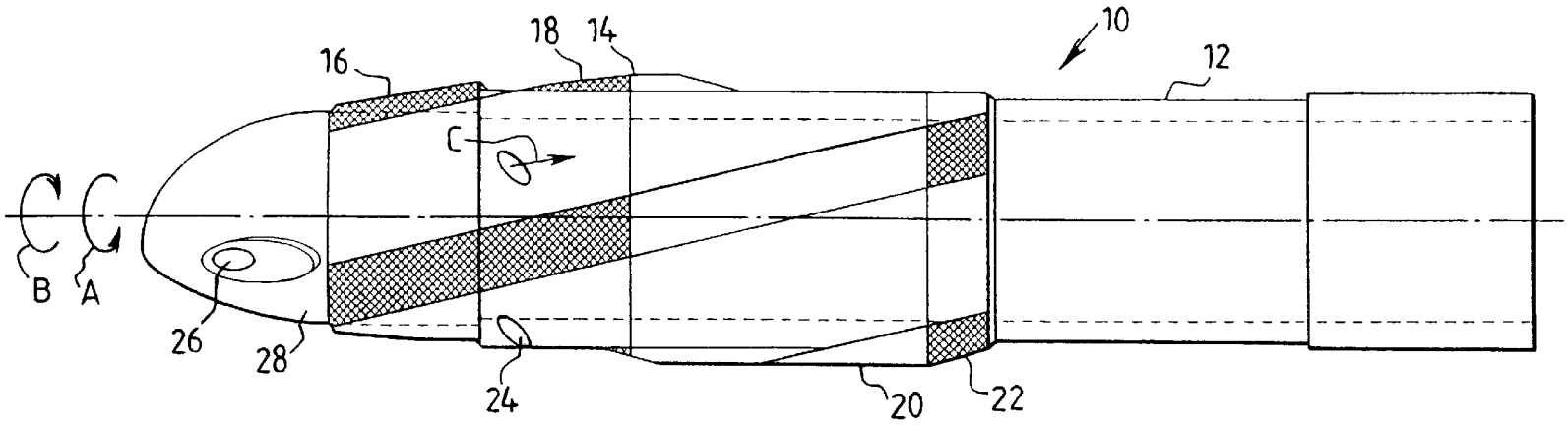
FIG. 1 illustrates a liner shoe in accordance with a first embodiment of the present invention.

Reference is first made to FIG. 1 of the drawings, which illustrates a liner shoe in accordance with a first embodiment of the present invention. The shoe 20 has a hollow cylindrical body 12 adapted for mounting on the lower end of a length of bore liner (non shown). Typically, such mounting will be achieved by a conventional threaded box and pin type arrangement.

The body carries four reaming members extending helically around the body 12 towards the leading end of the body in the opposite direction to the intended direction of rotation of the liner: in the Figure, arrow A illustrates the direction of the reaming member 14, while arrow B illustrates the direction of rotation of the shoe 10 in use.

The leading end of each reaming member 14 comprises a pilot reaming portion 16 and a following larger diameter reaming portion 18. Rearwardly of the reaming portions 16, 18 each reaming member 14 defines a stabilizing portion 20. Further, the trailing edge of each reaming member 14 defines a back reaming portion 22. The reaming portions 16, 18, 22 are provided with an aggressive surface formed of blocks of tungsten carbide welded to the body 12. However, each stabilising portion 20 has a relatively smooth outer surface formed of machined tungsten carbide.

As noted above, the body 12 is hollow and thus flay carry a drilling fluid which is pumped from surface through the liner. Rearwardly directed jetting ports 24 communicate with the body bore such that, in use, drilling fluid is directed rearwardly, in the direction of arrow C, to clear cuttings from between the reaming members 14.

A jetting port 26 is also provided in an eccentric nose portion 28 which is threaded onto the end of the body 12. The nose portion 28 is formed of relatively soft aluminum allay, such that it may be drilled out of the body 12 once a liner is in place, to provide a clear bore through the liner and the shoe 10.

In use, the shoe 10 is mounted on the lower end of a length of liner, which is then run into a bore. The upper section of the bore will have been previously lined with steel casing, such that initial passage of the shoe and liner into the bore should be relatively straightforward. However, as the shoe 10 and the leading end of the liner move into the lower unlined part of the bore, the shoe 10 is likely to encounter ledges, deposits of cuttings, and other obstructions. These may be dislodged or pushed aside by the shoe 10, or the fluid passing from the shoe 10. However, on occasion it may be necessary to rasp or ream past an obstruction using the reaming members 14. This may be achieved by rotating the liner and shoe 10 in the direction a such that the pilot reaming portions 16 and the reaming portions 18 rasp or ream the obstruction to an extent that the shoe 10 and the liner may pass. Due to the mass and dimensions of a typical section of liner, and the fact that the liner is suspended on relatively flexible drill pipe, it is often not possible to apply a significant torque to the shoe 10. However, the action of the reaming portions 16, 18 will normally be sufficient to overcome any obstructions. Further, the orientation of the reaming portions 16, 18 ensure that the reaming members 14 ride over any obstructions and do not bite into the obstruction, as might occur if the members 14 were to extend in the opposite direction. In this example it may be observed that the reaming members 14 are "left handed", that is the members 14 extend counter clockwise around the body 12, as the shoe 10 is to be rotated in a clockwise direction. In some situations it may be sufficient to reciprocate the liner and shoe 10 axially to rasp or ream past an obstruction.

The provision of a pilot reaming portion 16, and also the provision of a cutting or rasping surface over she surface of the reaming portions 16, 18, further minimise the possibility of the reaming members 14 jamming or locking against an obstruction.

As the configuration of the reaming members 14 is such that the rotation of the shoe lo will not tend to dislodge cuttings and other debris from between the members 14, the jetting ports 24 ensure that the channels between the members 14 remain clear.

Figure 2:
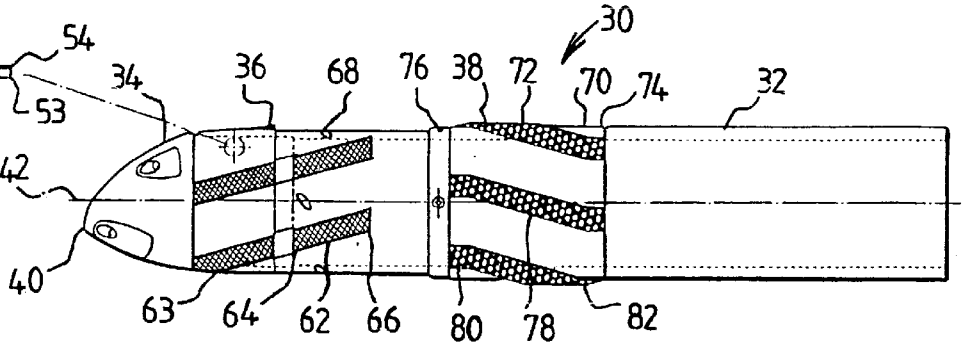
FIG. 2 illustrates a liner shoe in accordance with a second embodiment of the present invention.
Figure 3:
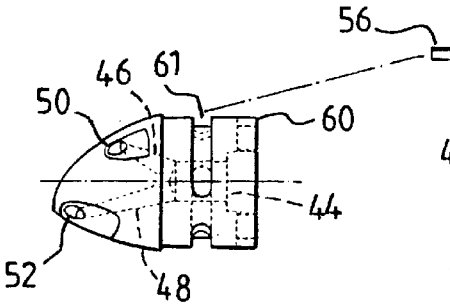
FIGS. 3 and 4 are side and end views of the nose of the shoe of FIG. 2.
Figure 4:
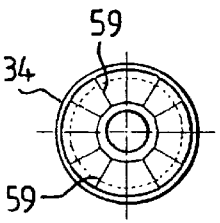

Reference is now made to FIGS. 2, 3 and 4 of the drawings, which illustrate a casing shoe 30 in accordance with a second embodiment of the present invention. The shoe 30 has a generally cylindrical tubular body 32 adapted for mounting on the lower end of a string of casing or liner (not shown)g. A nose cone 34 is mounted on the leading end of the body 32, and directly behind the nose on the body are a series of six reaming members 36 (the number of reaming members will typically be determined by the shoe diameter, that is, the larger the diameter the greater the number of member,). A centralizer 38 is mounted on the body 32 rearwardly of and longitudinally spaced from the reaming members 36.

The nose cone 34 in of generally frusto-conical form, with the nose leading end 40 being offset from the longitudinal axis of the shoe 42. A central fluid conduit 44 in the nose communicates with the interior of the body and, in use, directs fluid to two smaller diameter conduits 46, 46 which terminate at longitudinally and circumferentially spaced outlet ports 50, 52. The nose cone 34 is axially fixed but is rotatable through 146° relative to the body 32, around the axis 42. The nose cone 34 is located relative to the body 32 by pins 54, each pin 54 having a threaded outer portion 56 for engaging a corresponding threaded bore 56 in the body 32 and an inner portion 58 for location in an annular groove 61 defined by a reduced diameter rear portion of the nose cone GO. The groove 61 also accommodates springs (not shown) which tend to centre the cone in a predetermined position relative to the body 32.

If reference is made in particular to FIG. 4, it will be noted that the interior of the rear portion of the nose cone 34 defines a series of radial slots 59, which slots assist in the milling out of the nose cone 34 once the liner is in place; the relatively soft aluminum alloy from which the nose cone has been machined may tend to "smear" over a milling tool, and the slots facilitate the break-up of the cone and reduce the likelihood of such smearing.

The reaming members 36 are formed of an aggressive cutting material, such as tungsten carbide blocks, welded to the leading and of the body to define reaming blades. Each blade 36 comprises a leading pilot portion 63 which defines a taper extending rearwardly and helically from the nose cone 34. Rearwardly of each pilot portion 63 is a larger diameter reaming portion 62 with tapering leading and trailing ends 64, 66, each reaming portion being spaced from but helically aligned with the respective pilot portion 63. It should be noted that, as the leading end or each blade 36 overlaps longitudinally the trailing end of an adjacent blade 36, the blades 36 collectively provide 360° coverage of the body.

Like the first described embodiment, fluid outlet ports 68, which communicate with the interior of the body, are provided between the blades 36. in this embodiment it will be noted that adjacent ports 68 are longitudinally offset, to minimise weakening of the body 32.

The centraliser 38 is located at the longitudinal centre of the shoe 30 and comprises a bushing 70 defining five blades 72, although the number of blades may be varied as desired. The bushing 70 is rotatable on the body and is located between a body shoulder 74 and a lock ring 76. In use, two fluid conduits (not shown) carry fluid from the body interior to lubricate the bearing surfaces between the bushing 70 and the body 32, The blades 72 each comprise a main helical portion 78 and axial leading and trailing portions 80, 82.

In use, the shoe 30 is mounted on the lower end of a casing string and run into a well bore. As the shoe 30 passes through the bore the nose 34 will tend to push aside any sand, cuttings and the lice which have gathered in the bore, to allow the liner to pass. Any irregularities and intrusions in the bore wall will be rasped or reamed to the required diameter by the blades 36. Due to the overlapping blade configuration, such rasping and reaming may be achieved solely by axial movement of the shoe 30 through the bore, and may be enhanced by rotating the shoe. As described above with reference to the first described embodiment, the blade configuration and orientation is such that, if the shoe is rotated, the blades 36 will tend to ride over and rasp or ream away any obstructions, rather than bite into the obstruction.

Rotation of the shoe, and the following liner string, is facilitated by the provision of the centraliser 18, which acts as a rotary bearing between the shoe 30 and the bore wall. The configuration of the centraliser blades 72 also facilitates fluid flow past the shoe.

In the event of the shoe encountering a ledge or the like, the ability of the eccentric nose cone 34 to rotate relative to the body 32 facilitates negotiation of the ledge, as the nose 34 may "roll off" the ledge, particularly where the shoe itself is not rotating.

If, for any reason, it is deemed necessary to retract or withdraw the shoe 30, the tapering of the shoe towards its leading end and the absence of any reduced diameter portions rearwardly of nose, such as occur rearwardly of the stabiliser portions 20 in the first described embodiment, facilitate such withdrawal. Retraction of the shoe should be possible without back reaming, which of course is not possible in applications where there is no facility to rotate the liner string.

Figure 5:
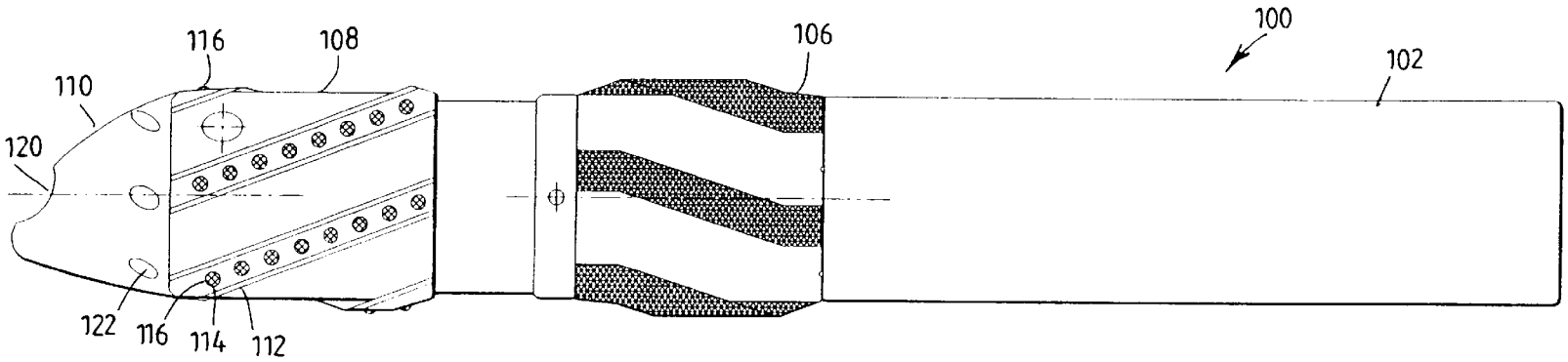
FIG. 5 illustrates a liner shoe in accordance with a third embodiment of the present invention.
Figure 7:
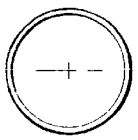
FIG. 7 is an end view of a retaining ring of the shoe of FIG. 5.
Figure 6:
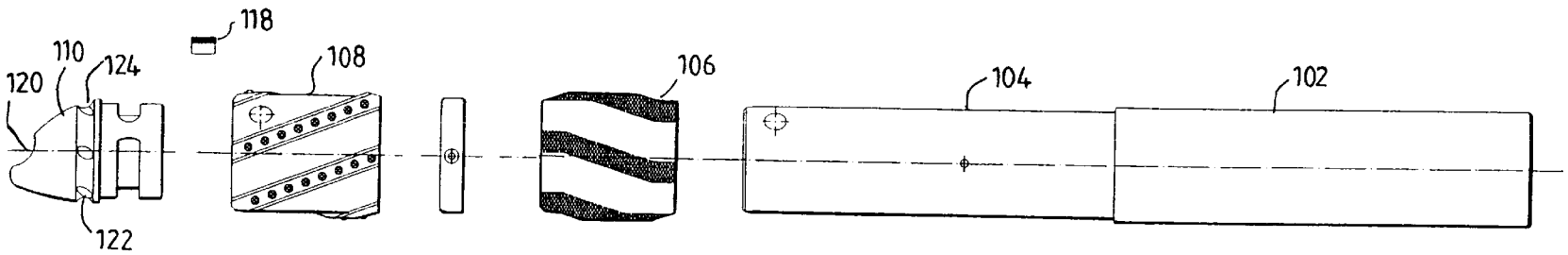
FIG. 6 is an exploded view of the shoe of FIG. 5.

Reference is now made to FIGS. 5, 6 and 7 of the drawings, which illustrate a casing shoe 100 in accordance with a third embodiment of the present invention. The shoe 100 has a generally cylindrical tubular body 102 having a reduced diameter leading end portion 104 which carries a centraliser 106, a reamer sleeve 108 and a nose 110, as will be described.

The centraliser 106 is substantially similar to the centraliser 38 described above, and will therefore not be described in any detail, The reamer sleeve 108 comprises five helical reaming blades or members 112 of substantially constant radial extent. Each member 112 defines a row of blind bores 114 which retain a respective tungsten carbide insert 116, in the illustrated example each member 112 having eight inserts 116. The bores 114 are sized such that the inserts 116 may be pressed in, without requiring any welding and thus avoiding the corresponding stresses and material changes which welding induces.

A threaded pin 118 is used to lock the sleeve 108 to the body 102, the inner end portion of the pin serving to retain the nose 110 on the end of the body 102.

The nose 110, like the nose cone 34 described above, is rotatable to a limited extent relative to the body and has a leading end offset from the shoe axis 119. However, the configuration of the fluid outlet ports 120, 122 of this embodiment are different, there being a single outlet port 120 aligned with the axis 119 for directing fluid forwards, and a series of circumferentially spaced ports 122 around the base of the nose 110, the ports 122 opening into a circumferential groove 124. In use, ports 122 direct fluid rearwardly over the reaming members 112, to assist in maintaining the members 112 clear of debris.

It will be apparent to those of skill in the are that the configuration of the body 102, sleeves 106, 108 and nose 110 will facilitate manufacture and assembly of the shoe 100, and provide for flexibility in manufacture, in that a single form of body 102 may accommodate centralisers and reamer sleeve having, for example, blades of different configurations, as desired It will be clear to those of skill in the art chat the above-described embodiments are merely exemplary of the present invention, and that various modifications and improvements may be made thereto, without departing from the scope of the present invention.

What is claimed is:

1. A tubing shoe comprising: a body for mounting on the end a tubing string of bore-lining casing or liner, the body being of similar diameter to the casing or liner; reaming members extending longitudinally and helically around the body, the reaming members providing substantially complete circumferential coverage of the body whereby, in use, when the tubing shoe is advanced axially into a bore, the reaming members provide reaming around the shoe circumference; and a torque reducing centralizer rotatably mounted externally of the body.

2. The shoe of claim 1, further comprising a fluid conduit and a bearing area disposed between the centralizer and the body, said bearing area being in fluid communication with the conduit such that said conduit supplies lubricating fluid to the bearing area.

3. The shoe of claim 1, wherein the centralizer defines a plurality of external blades or flutes.

4. The shoe of claim 3, wherein the plurality of blades extend helically.

5. The shoe of claim 4, wherein the plurality of blades include at least one blade having axially extending leading and trailing end portions.

6. The shoe of claim 5, wherein the plurality of blades extends in the same direction as the reaming members.

7. The shoe of claims 4, wherein the plurality of blades extends in the opposite direction to the reaming members.

8. A tubing shoe comprising: a hollow body for mounting on the end of a tubing string of casing or liner, and the body being of similar diameter to the casing or liner; and a torque reducing sleeve or centralizer disposed on the body, the torque reducing sleeve or centralizer being rotatably mounted externally of the body.

9. A method of clearing a bore and rasping a wall of the bore to receive tubing, the method comprising:

mounting a tubing shoe on the end of a tubing string, the shoe having a body and reaming members extending longitudinally and helically around the body, the reaming members providing substantially complete circumferential coverage of the body;

advancing the tubing shoe and the tubing string into the bore; and moving the tubing shoe and the tubing string axially in the bore, with the tubing shoe reaming members rasping the wall of the bore around the shoe circumference.

10. A tubing shoe comprising a body for mounting on a lower end of rotatable casing or liner adapted for rotation in a clockwise direction, and a rigid reaming portion comprising reaming members extending helically around the body towards a leading end thereof in a counter-clockwise direction.

11. The shoe of claim 10, wherein the body and reaming portion are substantially cylindrical.

12. The shoe of claim 10, wherein each reaming member includes a pilot reaming portion adapted for reaming a bore to a first diameter and a following reaming portion adapted for reaming the bore to a second diameter larger than said first diameter.

13. The shoe of claims 10, wherein the reaming portion includes a cutting surface.

14. The shoe of claim 13, wherein the cutting surface is provided by inserts of relatively hard material fixed to one of the body and the reaming members.

15. The shoe of claim 10, wherein a torque reducing centraliser is provided on the body rearwardly of the reaming portion.

16. The shoe of claim 15, wherein the centralizer is spaced rearwardly of the reaming portion.

17. The shoe of claim 15, wherein the centralizer is rotatable relative to the body.

18. The shoe of claim 15, wherein the centraliser defines raised helical blades extending in an opposite direction to the reaming members.

19. The shoe of claim 18, wherein the centralizer blades each include substantially axially extending leading and trailing end portions.

20. The shoe of claim 10, wherein trailing edges of each reaming member define a back reaming portion.

21. The shoe of claim 10, wherein the shoe tapers towards the leading end thereof.

22. The shoe of claim 10, wherein the body defines a fluid transmitting conduit in communication with fluid outlets.

23. The shoe of claim 22, wherein the fluid outlets are located on sides of the body, between the reaming members.

24. The shoe of claim 22, wherein fluid outlets are provided on a nose portion on the body, the outlets being directed rearwardly to direct fluid rearwardly towards or between the reaming members.

25. The shoe of claim 10, wherein the body includes a nose portion.

26. The shoe of claim 25, wherein the leading end of the nose portion is offset from the shoe axis.

27. The shoe of any of claim 25, wherein the nose portion is formed of a relatively soft material.

28. The shoe of claim of claim 25, wherein the nose portion defines at least one jetting port.

29. The shoe of claim 28, wherein said at least one port is disposed proximate a leading end of the nose portion.

30. The shoe of claims 29, further comprising a jetting port located on a longitudinal shoe axis.

31. The shoe of claim 28, wherein said at least one jetting port is disposed proximate a trailing end of the nose portion for directing fluid rearwardly towards the reaming members.

32. The shoe of claim 28, further comprising a plurality of ports disposed on the nose portion and opening into respective recesses formed in a surface of the nose portion.

33. The shoe of claim 25, wherein the nose portion is rotatable relative to the body.

34. The shoe of claim 33, wherein the nose portion is rotatable only to a limited extent, to facilitate the drilling or milling out of the nose.

35. A method of reaming a bore in preparation for receiving tubing, the method comprising the steps of:

mounting a tubing shoe on the lower end of tubing, the tubing shoe comprising a body and reaming members extending helically around the body towards the leading end thereof in a counter-clockwise direction;

running the tubing into a bore; and rotating the tubing in a clockwise direction.

36. A tubing shoe comprising: a fluid transmitting body for mounting on the lower end of tubing; reaming members on the body; and fluid outlets disposed in sides of the body and oriented to direct fluid towards or between the members.

37. A method of reaming a bore in preparation for receiving tubing, the method comprising the steps of:

mounting a tubing shoe on the lower end of tubing, the tubing shoe comprising a fluid transmitting body, reaming members disposed on the sides of the body, and fluid outlets disposed in the sides of the body for directing fluid towards or between the members;

running the tubing into a bore; and passing fluid through said outlets to exit the sides of the body.

38. A tubing shoe comprising: a body for mounting on the end of a tubing string; and a nose rotatably mounted on the body, the nose being rotatable about a longitudinal axis, and the degree of rotation of the nose relative to the body being restricted to facilitate drilling or milling through the nose.

39. A tubing shoe comprising:

a body for mounting on the end of a tubing string; and a rigid reaming portion comprising reaming members extending helically around the body and including inserts of relatively hard material located on circumferentially extending bearing surfaces of the reaming members.

40. The shoe of claim 39, wherein the bearing surfaces includes blind recesses and said inserts are an interference fit in said recesses.

41. The shoe of claim 40, wherein the nose is rotatable only to a limited extent, to facilitate the drilling or milling out of the nose.

42. A tubing shoe comprising: a body for mounting on a lower end of rotatable tubing; a rigid reaming portion comprising reaming members extending helically around the body towards a leading end of the body in an opposite direction to an intended direction of rotation of the tubing; and a nose portion which is rotatable relative to the body.

43. A tubing shoe comprising: a hollow body for mounting on the end of a tubing string, the body defining a throughbore; a torque reducing sleeve or centralizer disposed on the body, the torque reducing sleeve or centralizer being rotatably mounted on the body; a fluid conduit extending from the body throughbore; and a bearing area disposed between the sleeve or centralizer and the body, said bearing area being in fluid communication with the conduit such that said conduit supplies lubricating fluid from the body throughbore to the bearing area.

44. A tubing shoe comprising: a fluid transmitting body for mounting on the lower end of tubing, the leading end of the body including a nose portion; reaming members on the body; and at least one jetting port disposed proximate a trailing end of the nose portion for directing fluid rearwardly towards the reaming members.

45. A tubing shoe comprising: a fluid transmitting body for mounting on the lower end of tubing, the body including a nose portion, a leading end of the nose portion being offset from a longitudinal shoe axis; reaming members disposed on the body; and at least one jetting port located on said axis.

46. A tubing shoe comprising: a fluid-transmitting body for mounting on a lower end of rotatable tubing; a rigid reaming portion comprising reaming members extending helically around the body towards a leading end of the body in an opposite direction to an intended direction of rotation of the tubing; and fluid outlets arranged to direct fluid towards the reaming members.

* * * * *

UNITED STATES PATENT AND TRADEMARK OFFICE

CERTIFICATE OF CORRECTION

PATENT NO. : 6,401,820 B1
DATED : June 11, 2002
INVENTOR(S) : Ian Alastair Kirk

It is certified that error appears in the above-identified patent and that said Letters Patent is hereby corrected as shown below:

Column 1,
Line 23, replace “Where” and -- where --.

Column 5,
Line 5, replace “The” with -- the --.

Column 6,
Lie 38, replace “lo” with -- 10 --.

Column 7,
Line 1, replace “GO” with -- 60 --.

Column 10,
Line 23, delete “,”.

Signed and Sealed this

Thirty-first Day of December, 2002

JAMES E. ROGAN
*Director of the United States Patent and Trademark Office*

UNITED STATES PATENT AND TRADEMARK OFFICE

CERTIFICATE OF CORRECTION

PATENT NO. : 6,401,820 B1 
DATED : June 11, 2002
INVENTOR(S) : Ian Alastair Kirk et al.

It is certified that error appears in the above-identified patent and that said Letters Patent is hereby corrected as shown below:

Title page,
Item [75], Inventors, replace "Alistair Bertrum Clark" with -- Alistair Bertram Clark --.
Item [22], PCT Filed:, please replace "Jan. 24, 1998" with -- Jan. 25, 1999 --.

Signed and Sealed this

Second Day of November, 2004

JON W. DUDAS
*Director of the United States Patent and Trademark Office*